US005238130A

United States Patent [19]

Marques et al.

[11] Patent Number: 5,238,130

[45] Date of Patent: Aug. 24, 1993

[54] CLOSURE FOR A CONTAINER

[75] Inventors: Rui M. M. Marques, Mississauga; Terrance Reid, Thornhill; Manuel D'Oliveira, Etobicoke; Joseph Marques, Weston, all of Canada

[73] Assignee: 9866143 Ontario Inc., Toronto, Canada

[21] Appl. No.: 863,664

[22] Filed: Apr. 6, 1992

[51] Int. Cl.[5] ..... B65D 55/02

[52] U.S. Cl. ..... 215/216; 215/211; 215/217; 215/221

[58] Field of Search ..... 215/203, 206, 211, 213, 215/214, 216, 217, 221, 330, 334, 343, 344

[56] References Cited

U.S. PATENT DOCUMENTS

| | | | |
|---|---|---|---|
| 3,360,147 | 12/1967 | Schaefer . | |
| 3,698,584 | 10/1972 | Miller . | |
| 3,747,793 | 7/1973 | Wassilieff | 215/334 X |
| 3,826,395 | 7/1974 | Montgomery | 215/221 |
| 3,831,797 | 8/1974 | Stevens, Jr. . | |
| 3,841,514 | 10/1974 | Montgomery et al. | 215/216 |
| 3,857,508 | 12/1974 | LaBarge et al. . | |
| 3,884,379 | 5/1975 | Landen . | |
| 3,891,110 | 6/1975 | Gach . | |
| 3,917,097 | 11/1975 | Uhlig . | |
| 3,924,769 | 12/1975 | Fillmore . | |
| 3,941,268 | 3/1976 | Owens et al. . | |
| 3,944,101 | 3/1976 | Landen et al. | 215/216 |
| 3,949,893 | 4/1976 | Uhlig | 215/216 |
| 3,951,290 | 4/1976 | Montgomery . | |
| 3,958,708 | 5/1976 | Le Brun, Jr. . | |
| 3,984,021 | 10/1976 | Uhlig . | |
| 3,989,152 | 11/1976 | Julian . | |
| 3,993,208 | 11/1976 | Ostrowsky | 215/216 |
| 3,993,209 | 11/1976 | Julian . | |
| 4,116,351 | 9/1978 | Uhlig | 215/216 |
| 4,117,945 | 10/1978 | Mumford | 215/216 |
| 4,134,513 | 1/1979 | Mumford | 215/216 |
| 4,138,028 | 2/1979 | Price et al. . | |
| 4,213,534 | 7/1980 | Montgomery | 215/216 |
| 4,270,664 | 6/1981 | Buono . | |
| 4,280,631 | 7/1981 | Lohrman . | |
| 4,351,442 | 9/1982 | Summers | 215/216 |

FOREIGN PATENT DOCUMENTS

| | | | |
|---|---|---|---|
| 919104 | 1/1973 | Canada . | |
| 943494 | 3/1974 | Canada . | |
| 966433 | 4/1975 | Canada . | |
| 1023299 | 12/1977 | Canada . | |
| 1154369 | 8/1960 | Fed. Rep. of Germany . | |
| 2952778 | 2/1981 | Fed. Rep. of Germany . | |
| 9004546 | 5/1990 | PCT Int'l Appl. | 215/214 |

*Primary Examiner*—Allan N. Shoap
*Assistant Examiner*—Vanessa Caretto
*Attorney, Agent, or Firm*—Bereskin & Parr

[57] ABSTRACT

A closure is provided for a container having an externally threaded neck and a plurality of locking teeth. The closure has a first outer side wall, a second inner side wall, and projections within the outer side wall for engaging the locking teeth of the container, to prevent removal by children and the like. The outer side wall can be distorted to displace the locking projections, for opening the container. For forming a seal with the neck of a container, one or both of a textured finish on an annular sealing surface within the second inner side wall, and an internal sealing lip are provided. This eliminates the requirement for a separate sealing liner.

22 Claims, 2 Drawing Sheets

CLOSURE FOR A CONTAINER

FIELD OF THE INVENTION

This invention relates to a closure for a container, and more particularly is concerned with a closure for a plastic bottle or the like which is child resistant, that is, it is resistant to being removed by a child.

BACKGROUND OF THE INVENTION

It has long been recognized that there are numerous substances which are harmful to children and other people, such as the mentally handicapped. Such substances include paints, solvents, industrial chemicals, pesticides, toxic chemicals, cleaning solutions, and a variety of medicines both in liquid and solid form. It will further be realized that many of these substances can be found in a typical home. In many cases, they are kept in locations that are readily accessible to children. For example, it is common to keep cleaning materials in cupboards beneath the kitchen sink, which is at ground level and readily accessible to children.

Due to the inherent inquisitive nature of children, there are numerous instances where children gain access to containers holding such materials, and then open them. Particularly for very young children, a natural tendency with any new substance is to taste it. This can lead to severe injuries, and in some cases death of the child, if prompt action is not taken.

Accordingly, there have been developed a large variety of closures which are intended to be child-resistant. Generally, these closures provide some sort of mechanism that requires the user to have a certain level of manual dexterity or strength, and/or intelligence, which it is assumed would not be found in a child or a person who should not be opening the container. There have been two fundamentally different approaches to the design of such closures.

In one approach, a closure comprises two parts. There is an inner part which actually engages the bottle neck and forms the actual seal. An outer part is intended to be gripped by the user. The outer part is arranged so that, for unscrewing or opening of the closure, the user must manipulate it in a certain way for it to engage the inner closure, otherwise, the outer part will simply rotate freely without unscrewing the inner part. Commonly, it is necessary for the user to press down on the outer part whilst rotating it. Usually, a child will either not be able to read the instructions to this effect, or will not have the strength or dexterity to perform this operation.

An alternative approach is to have a one-piece cap or closure, which interacts with one or more locking projections or teeth on the neck of the container or bottle. There are a large number of earlier proposals embodying this approach, utilizing projections or teeth that extend both radially and axially. Very generally, these proposals provide for some sort of ratchet mechanism whereby locking projections of the cap automatically ride over the teeth or projections of the bottle neck during closure, but engage those projections to prevent unintended opening of the container. Different mechanisms are provided to enable this locking mechanism to be released. For axially extending projections or teeth, sometimes a portion of the cap is configured so that it can be raised to disengage the locking mechanism. For radially extending locking projections, one common technique is to provide two diametrically opposed locking projections on the cap itself. The cap is then configured so that by squeezing the cap at two locations mid way between the locking projections, the cap will distort to displace those locking projections radially outwards, to disengage the locking mechanism.

While considerable thought has been put into developing these earlier proposals, with a variety of degrees of success, to applicant's knowledge no effort has been expended on developing a truly one-piece cap. More particularly, to applicant's knowledge, current child-resistant caps that are available require some sort of resilient liner, typically expanded polystyrene, to form a seal between the top wall of the cap and the lip of the container or bottle. Thus, even the so-called one-piece cap referred to above requires the presence of a liner for forming the seal.

The presence of such a liner does have some advantages. It can overcome imperfections in the neck of the container or the interior of the cap itself. Further, within certain limits, it can overcome problems due, for example, to the side wall of the cap distorting and permitting the top wall to lift at certain points from the neck of the container.

However, the provision of a separate seal also has significant disadvantages. It requires the presence of a separate component which has to be produced separately and then inserted into the cap. It has to be inserted in such a manner as to ensure that it does not fall out before the cap is placed onto the neck of the bottle, usually requiring an adhesive layer. This adds to the cost of the closure.

Further, at the present time, there is increasing pressure and incentives to make containers recyclable. In particular, there are many products which are sold at relatively low costs and in relatively large volumes. For example, windshield washer fluid is typically sold in containers having a four liter size or similar, and such a product is sold in large quantities at relatively low cost. This generates a large volume of containers that have to be disposed of. Typically, the container is made from polyethylene and the cap is made from polypropylene. Such materials by themselves are capable of being recycled and reused. However, the presence of the expanded polystyrene foam liner renders a container, or at least its cap, unsuitable for recycling.

Accordingly, it is highly desirable that a child-resistant closure be formed truly as one-piece, so as to make manufacture simpler and more economically, and to render a combined container and cap recyclable. It is therefore desirable that the cap and container together be manufactured so as to be capable of forming an adequate seal between them, without requiring the presence of a separate, resilient sealing element.

In accordance with the present invention, there is provided a closure for a container having an externally threaded neck and a plurality of radially extending locking teeth, the closure comprising: a top wall; a first outer side wall including a pair of projections which extend generally axially along an inner surface of the outer wall and which project radially inwardly, for engagement with locking teeth of a container neck; a second, inner side wall located within the outer wall, including an internal screw thread for engaging the external thread of a container neck; and one or more of an annular sealing surface with a textured finish, a plurality of reinforcing ribs around the second, inner side wall and a central sealing lip that extends axially from the top wall and concentrically within the second inner wall, with the second wall and the sealing lip defining an annular sealing surface that, in use, abuts a free end of the container neck to seal and close the container.

The annular sealing surface of the closure could, either in addition to the central sealing lip or instead of the sealing lip, be provided with a textured or roughened surface finish, for example by EDM machining, so as to improve the sealing properties with the free end of the container neck.

Further, it is preferable for the central, sealing lip to have a conical external taper or face and it is preferably dimensioned so as to form an interference fit with the interior of the neck. This ensures that there are, in fact two sealing lines or surfaces at the free end of the neck. One seal is provided between the inside of the neck and the central, sealing lip, whilst the other seal is provided between the actual end surface of the neck and the annular sealing surface of the end wall of the closure.

BRIEF DESCRIPTION OF THE FIGURES

For better understanding of the present invention, and to show more clearly how it may be carried into effect, reference will now be made, by way of example, to the accompanying drawings, which show a preferred embodiment of the present invention, and in which.

DESCRIPTION OF PREFERRED EMBODIMENT

Figure 1:
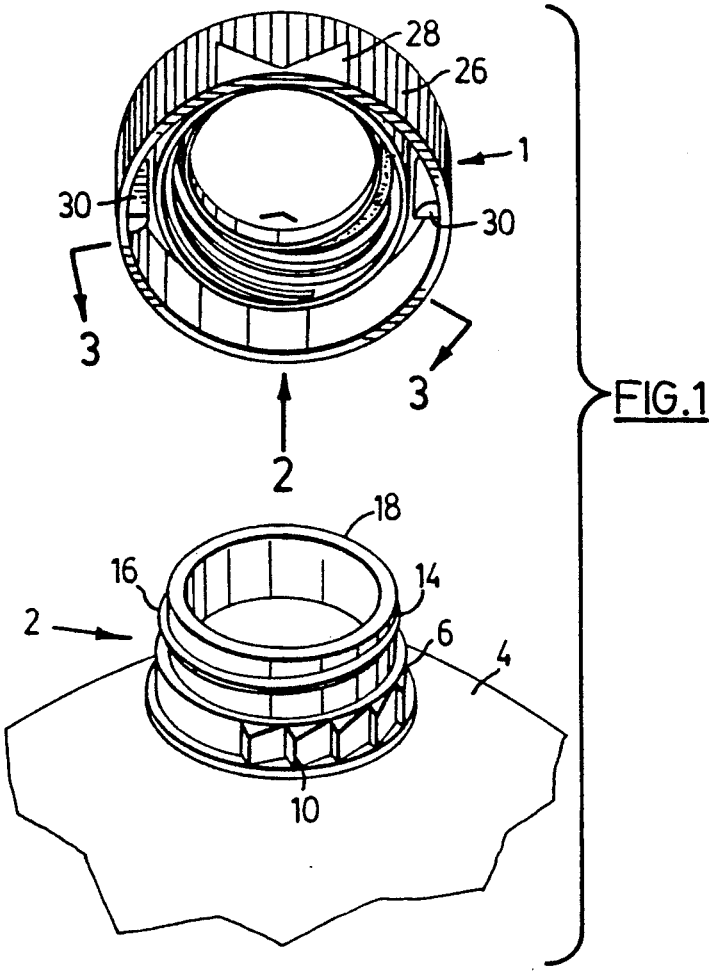
FIG. 1 is a perspective, exploded view of the neck of a bottle and a closure according to the present invention.

Referring first to FIG. 1, there is shown a closure in accordance with the present invention generally designated by the reference 1, and the neck or upper part of a bottle, which is generally designated by the reference 2.

The bottle 2 is formed in known manner by blow moulding, and is formed from high density polyethylene. The shape of the bottle itself is immaterial to the present invention, and the bottle can take a variety of shapes dependent on other considerations, for example, the size of the bottle and industry or other standards for particular bottle types. A bottle might have a handle moulded into it. At the top of the bottle there is an annular shoulder 4.

Figure 4:
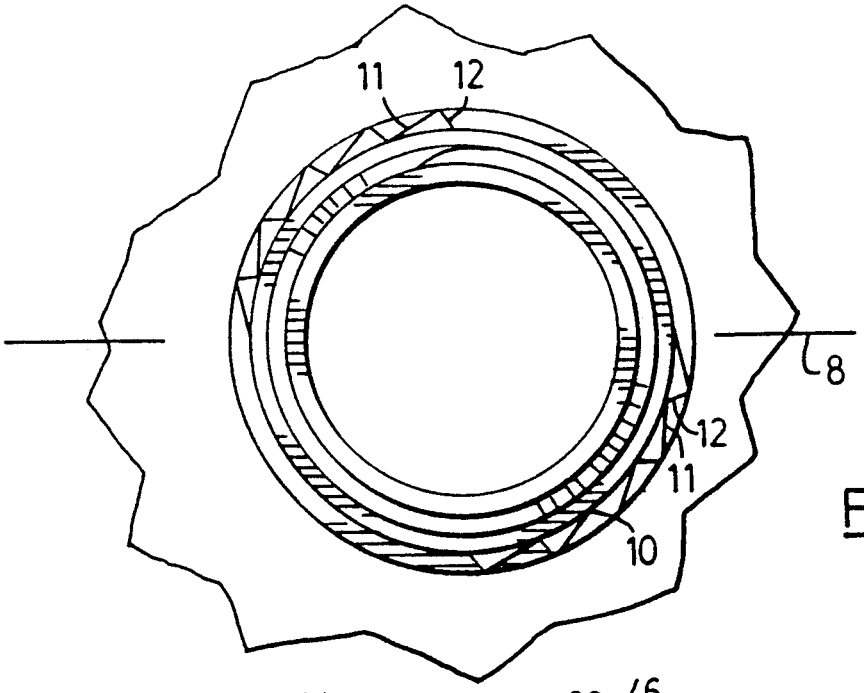
FIG. 4 is a plan view of the neck of the bottle.

Extending outwardly from the annular shoulder 4 is a locking section 6 which is generally cylindrical and which is provided with two series of locking teeth, there being five teeth in each series (as best shown in FIG. 4). The angular spacing of the teeth is 18½°, so that a complete series of five teeth extends through approximately 92°. As shown in the plan view of FIG. 4, the start of each series of teeth is angularly offset from a central plane 8 of the bottle by a small amount, here approximately 7½°. The bottle is symmetrical about the central plane 8.

Above the locking section 6, there is a threaded section 14 of the bottle neck which includes a single start thread 16, which may have a variety of profiles. Here, in section, the lower flank of the thread is at a relatively small angle to the horizontal, whilst the upper flank of the thread is at a greater angle to the horizontal. It will be appreciated that as it is the underside of the thread which is engaged by the thread of a cap or closure 1 in the closed position, only the profile of the underside of the thread is significant.

Figure 2:
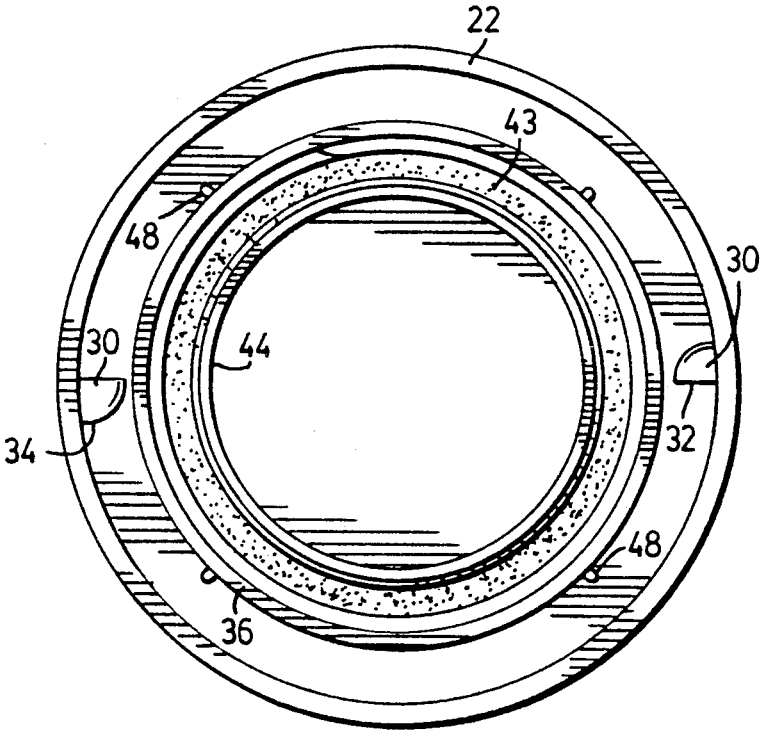
FIG. 2 is a plan view of the closure of the present invention, in the direction of arrow 2 of FIG. 1.
Figure 3:
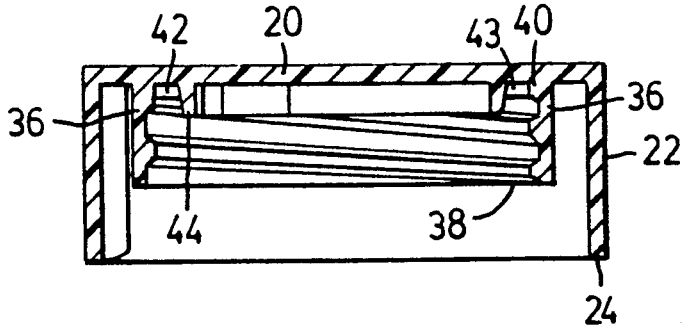
FIG. 3 is an axial section through the closure of the present invention, along line 3—3 of FIG. 1.

Turning now to details of the closure or cap 1 itself, these are shown principally in FIGS. 1–3. The closure 1 includes a top wall 20 which is of generally uniform thickness and is substantially circular. The top surface of the wall 20 can be moulded in a manner to include instructional information, or trade marks. The instructional information could be in a form of arrows and/or written instructions.

Extending downwardly from the outer edge of the top wall 20 is a first, outer side wall 22 which is generally circular. The outer side wall 22 includes a lower or free edge portion 24. The main central portion of the wall 22 includes ribbing 26 comprising a plurality of small ribs that extend axially and are uniformly spaced. Between each pair ribs, there is a shallow recess of part-circular shape. The ribbing 26 is to facilitate the cap being grasped by user, and a variety of different forms of ribbing and the like can be applied to the external surface of the closure 1. Diametrically opposed gripping portions 28 are provided. These portions are, in effect, filled in portions of the ribbing 26, which are flush with the top of the ribs. The portions 28 are an indication as to where the closure 20 should be grasped by a user, as detailed below.

As part of the locking mechanism, two locking projections 30 are provided on the inside of the first side wall 22. Each projection, in section, has generally the shape of a quadrant. As shown, each projection 30 extends axially along the inner surface of the side wall 22 and projects radially inwards to a location close to a second, inner side wall 36. Each projection 30 extends down to close to the lower end of the side wall 22, so as to be substantially flush with it. The projections 30 are sized so as to give a significant reinforcing effect to the side wall 22, and for this purpose the spacing between them and the inner side wall 36 is minimised. The projections or posts 30 are not joined to the inner side wall 36, as the side wall 36 would be distorted when the first side wall 22 is ovalised during opening of a container. Each projection 30 includes a planar radial face 32 and a curved face 34. As detailed below, the planar face 32 is intended to abut locking surfaces 12 of the locking teeth, whilst the rounded or curved face 34 is intended to enable the projections 30 to ride over the inclined surfaces 11 of the locking teeth during closure of a container. The face 34 could be any suitably inclined surface that causes deflection of the projections 30, rather than locking engagement.

The projections 30 are located midway between the portions 28, i.e. they lie on a diameter perpendicular to a diameter on which the portions 28 lie. This ensures that the projections 30 are displaced radially outward when the portions 28 are squeezed together.

Within the first side wall 22, there is a second inner side wall 36, which is cylindrical and concentric with the first side wall 22. The side wall 36 is provided with a screw thread 38, corresponding to the thread 16 of the bottle neck. The screw thread 38 has, in section, an upper flank that is inclined at a small angle to the horizontal and corresponds to the angle of the lower flank of the thread 16. The lower flank of the screw thread 38, in section, is inclined at a greater angle to the horizontal, and it will be appreciated that this only contacts the top flank of the screw thread 16 when the closure 1 is placed on the bottle neck 2.

At the upper end of the side wall 36, there is an annular portion 40 having the same internal diameter as the internal diameter of the thread 38. The annular portion 40 defines one edge or side of a channel 42, for receiving the free end or lip of the bottle neck, indicated at 18.

In accordance with the present invention, there is provided a sealing lip 44, which is generally circular and is again concentric with the first and second side walls 22, 36. The sealing lip 44 has a generally cylindrical inner surface, and a conical outer surface or face 46, which, in section, is inclined at angle 8° to the vertical. The sealing lip 44 together with the annular portion 40 defines the channel 42.

The bottom of channel 42, which abuts the end surface 18 of the bottle neck forms an annular sealing surface 43, which is provided with a textured finish by EDM (electrical discharge machining) of the corresponding surface of a mould for the cap 1.

The annular portion 40 serves to sandwich a bottle neck between it and the sealing lip 44. To enable the bottle end surface to abut the surface 43 with the EDM finish, the portion 40 should be relatively shallow in the axial direction.

To reinforce the second side wall 36, four reinforcing ribs 48 are provided, which are symmetrically disposed about the side wall, as shown in the plan view of FIG. 3. Each of these ribs is approximately semi-circular in cross-section, and extends parallel to the axis of the closure 1. The purpose of the ribs 48 is to ensure that the side wall 36 is sufficiently stiff that it will be firmly engaged with the threaded section 14 of the bottle neck and not distort. This ensures that the sealing surface 43 is brought into uniform engagement with the end surface 18 of the bottle neck.

If any part of the side wall 36 is permitted to deform, and applicant has found that this is not an uncommon occurrence with known designs, then this can allow the end of the closure 1 to become displaced away from the neck and surface 18 at a certain point, permitting leakage.

In use, a container would be filled with a desired liquid or other product, and the closure 1 brought into engagement with the bottle neck 2 in known manner. This would usually be effected automatically by conventional machinery. The closure 1 is then screwed down onto the bottle neck 2. During this action, the curved faces 34 of the projections 30 would cause the projections to be deflected radially outwards as they ride over the teeth 10. The side wall 22 has sufficient resiliency to permit this action, and the side wall 22 will momentarily be ovalised as the projections 30 are displaced away from one another when they ride over the teeth 10. Preferably, the starts of the two screw threads 16, 38 are so arranged that, in a fully engaged position of the closure 1, the projections 30 engage two of the teeth 10.

Figure 5:
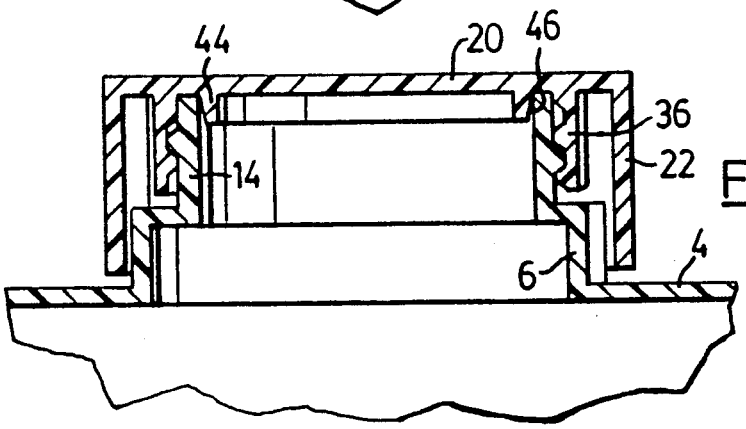
FIG. 5 is an axial section through the closure when fitted to the neck of the bottle.

In the fully closed position, as shown in FIG. 5, a first seal is formed between the sealing surface 43, with EDM finish, and the end surface 18 of the bottle neck. Simultaneously, the conical inner surface 46 of the sealing lip 44 comes into contact with the inner surface of the bottle neck. For this purpose, the bottle neck is made to sufficiently tight tolerances to ensure that this contact occurs. A second seal is therefore formed between the bottle neck and the surface 46.

In use, in known manner, the user grips the two opposite portions 28 of the closure 1. This distorts the cap causing the two projections 30 located midway between the mount portion 28 to be deflected outwards. This enables closure 1 to be rotated anti-clockwise. The projections 30 have an axial extent such that one rotation of 180° will be insufficient to raise the projections 30 clear of the teeth 10. Therefore, the user will have to release and then regrip the closure 1 at a fresh position. This will again distort it as is outlined and it can then be rotated further. The projections 30 should then be clear of teeth 10, and any further rotation applied to the closure 1 should remove it from the bottle neck 2.

As the closure 1 does not include any liner or seal, it can be reused as many times as desirable. Many caps employ a liner of expanded polystyrene foam or the like, which will frequently become inelastic or lose its "memory", and hence its sealing properties will be degraded. Here, this is not a problem, the closure 1 can be removed and replaced as many times as desired.

With regard to preferred material, it is preferred for the bottle container to be blow molded from high density polyethylene, although the invention is applicable to bottles formed from any suitable material. It is here noted that since no resiliency is required of the bottle neck or the teeth 10, a variety of materials can be used, including glass and ceramics. For the closure 1, it is preferred for this to be formed from polypropylene. Applicant has discovered that by adding a certain amount of talcum powder to the polypropylene, its stiffness can be increased to a desired level, to reduce problems due to unwanted distortion or the like. In particular, this prevents some wanted distortion of the second side wall 36 as the threads are tightened. It has been found that polypropylene filled with from 20–40% talcum powder gives satisfactory results.

We claim:

1. A closure for a container having an externally threaded neck and a plurality of radially extending locking teeth, the closure comprising: a top wall; a first outer side wall including a pair of projections which extend generally axially along the inner surface of the outer wall and project radially inwardly, for engagement with said locking teeth, each projection including a locking surface that is inclined at a relatively small angle to a radius of the closure for locking engagement with the locking teeth and an inclined surface that is at a relatively large angle to a radius of the closure for deflecting the projections over the locking teeth as the closure engages the threaded neck; a second inner side wall located within the outer wall, and including an internal screw thread for engaging the external thread of the neck of a container; and an annular sealing surface located concentrically within and adjacent the second inner wall, the annular sealing surface being generally planar and having a continuous roughened, textured finish, which provides a plurality of contact areas, randomly distributed across the annular sealing surface for, in use, abutting the free end of the neck of a container, to seal and close the container.

2. A closure as claimed in claim 1, which includes a central sealing lip extending axially from the top wall and concentrically within the second inner wall, which sealing lip includes an outer, conical face, dimensioned to engage and form a seal with the inner surface of a container neck.

3. A closure as claimed in claim 2, wherein the outer face of the sealing lip is wholly conical.

4. A closure as claimed in claim 3, wherein the outer face of the sealing lip, in section, is at an angle of approximately 8° to the axis of the closure.

5. A closure as claimed in claim 2, wherein the annular sealing surface is provided at the bottom of an annular channel, one side of which is defined by the sealing lip, wherein the second side wall includes an annular portion defining the other side of the annular channel.

6. A closure as claimed in claim 5, wherein the projections extend from the top wall to a location adjacent the free edge of the first side wall, and are substantially flush with the free edge of the first side wall.

7. A closure as claimed in claim 6, wherein each projection has a quadrant-shaped cross-section, with a straight side of the quadrant forming the locking surface and a curved side of the quadrant forming the inclined surface thereof.

8. A closure as claimed in claim 7, wherein each second side wall includes a plurality of reinforcing ribs which extend axially and are uniformly disposed about the exterior thereof.

9. A closure as claimed in claim 2, 3, 4, 5, 6, 7 or 8, wherein the roughened, textured finish is formed by electrical discharge machining.

10. A closure for a container having an externally threaded neck and a plurality of radially extending locking teeth, the closure comprising: a top wall; a first outer side wall including a pair of projections which extend generally axially along the inner surface of the outer wall and project radially inwardly, for engagement with said locking teeth, each projection including a locking surface that is inclined at a relatively small angle to a radius of the closure for locking engagement with the locking teeth and an inclined surface that is at a relatively large angle to a radius of the closure for deflecting the projections over the locking teeth as the closure engages the threaded neck; a second inner side wall located within the outer wall, and including an internal screw thread for engaging the external thread of the neck of a container; and an annular sealing surface located concentrically within and adjacent the second inner wall, the annular sealing surface being generally planar and having a continuous roughened textured finish, which provides a plurality of contact areas, randomly distributed across the annular sealing surface for, in use, abutting the free end of the neck of a container, to seal and close the container, wherein the textured annular sealing surface is formed by electrical discharge machining.

11. A closure as claimed in claim 1, 2, 3, or 10, wherein the projections extend from the top wall to a position close to a free edge of the first side wall and are substantially flush with the free edge of the first side wall.

12. A closure as claimed in claim 1, 2, 3, or 10, wherein the second side wall includes a plurality of axially extending reinforcing ribs around the exterior thereof.

13. A closure as claimed in claim 1, 2, 3, or 10, wherein the second side wall includes four reinforcing side ribs around the exterior thereof, which extend axially and are symmetrically disposed.

14. A closure as claimed in claim 1, 2, 5, 8, or 10, in combination with a container having an externally threaded neck, wherein the neck of the container bears two series of radially extending locking teeth with the teeth in each series being uniformly spaced and the two series of teeth being diametrically opposed to one another, and wherein the two locking projections are diametrically opposed to one another, whereby the locking projections simultaneously engage diametrically opposed pairs of locking teeth, the locking projections having an axial length such that the closure has to be rotated through more than 180° from a fully closed position, before the projections are clear of the locking teeth.

15. A closure as claimed in claim 14, wherein the container is symmetrical about a central plane, with the axis of the neck lying in the central plane, and wherein the two series of locking teeth are provided on either side of the central plane, with an angular offset between the central plane and the commencement of each series of locking teeth.

16. A closure for a container, having an externally threaded neck and a plurality of radially extending locking teeth, the closure comprising: a top wall; a first outer side wall including a pair of projections which extend axially along the inner surface of the outer wall and project radially inwardly, for engagement with said locking teeth, each projection including a locking surface that is inclined at a relatively small angle to a radius of the closure for locking engagement with the locking teeth and an inclined surface that is at a relatively large angle to the radius of the closure for deflecting the projections over the locking teeth during closure of a container; a second inner side wall located within the outer side wall, including an internal screw thread for engaging an external thread of the neck of a container; and a plurality of reinforcing ribs around the second, inner side wall, which extend axially and are uniformly disposed.

17. A closure as claimed in claim 16, which includes an annular sealing surface located concentrically within and adjacent to the second inner side wall, the annular sealing surface being generally planar and having a roughened, textured finish for forming a seal with the free end of a container neck.

18. A closure as claimed in claim 17, wherein the second inner side wall includes an annular portion on the inside thereof adjacent to the top wall, defining an outer edge of the annular sealing surface.

19. A closure as claimed in claim 18, which includes a central sealing lip extending axially from the top wall and concentrically within the second inner wall, which sealing lip includes an outer conical face, dimensioned to engage and form a seal with the inner surface of the container neck.

20. A closure as claimed in claim 19, wherein the outer face of the sealing lip, in section, is at an angle of approximately of 8° to the axis of the closure.

21. A closure as claimed in claim 16, wherein the reinforcing ribs are disposed symmetrically around the closure.

22. A closure as claimed in claim 16, 18, or 19, wherein the projections extend from the top wall to a location adjacent to a free edge of the first outer side wall, and are substantially flush with the free edge of that outer side wall.

* * * * *

UNITED STATES PATENT AND TRADEMARK OFFICE

CERTIFICATE OF CORRECTION

PATENT NO. : 5,238,130

DATED : August 24, 1993

INVENTOR(S) : Rui M.M. Marques et. al.

It is certified that error appears in the above-identified patent and that said Letters Patent is hereby corrected as shown below:

On title page,

At (73) Assignee: Replace "9866143..." with--986143...--

Signed and Sealed this

Sixteenth Day of August, 1994

Bruce Lehman

*Attest:*

BRUCE LEHMAN

*Attesting Officer*

*Commissioner of Patents and Trademarks*